US006220224B1

(12) United States Patent
Matthies et al.

(10) Patent No.: US 6,220,224 B1
(45) Date of Patent: Apr. 24, 2001

(54) FUEL-INJECTION SYSTEM FOR AN INTERNAL COMBUSTION ENGINE

(75) Inventors: Joerg Matthies, Daisendorf; Guenther Schmidt, Meckenbeuren, both of (DE)

(73) Assignee: MTU Motoren- und Turbinen-Union Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 09/381,582

(22) PCT Filed: Mar. 19, 1998

(86) PCT No.: PCT/EP98/01596

§ 371 Date: Nov. 10, 1999

§ 102(e) Date: Nov. 10, 1999

(87) PCT Pub. No.: WO98/42978

PCT Pub. Date: Oct. 1, 1998

(30) Foreign Application Priority Data

Mar. 22, 1997 (DE) ..... 197 12 135

(51) Int. Cl.[7] ..... F02M 55/02
(52) U.S. Cl. ..... 123/468
(58) Field of Search ..... 123/468, 469, 123/456, 467

(56) References Cited

U.S. PATENT DOCUMENTS 4,142,497 * 3/1979 Long ..... 123/456
4,417,557 * 11/1983 Walter ..... 123/456
4,467,766 * 8/1984 Wissman ..... 123/456
5,265,793 11/1993 Usui et al. ..... 228/127
5,497,750 3/1996 Mueller et al. ..... 123/446
5,592,968 * 1/1997 Nakashima et al. ..... 123/456
6,000,380 * 12/1999 Weisbarth ..... 123/456

FOREIGN PATENT DOCUMENTS 43 41 543 6/1995 (DE) .
43 44 190 6/1995 (DE) .

* cited by examiner

*Primary Examiner*—Thomas N. Moulis
(74) *Attorney, Agent, or Firm*—Evenson, McKeown, Edwards & Lenahan, P.L.L.C.

(57) ABSTRACT

The invention relates to a fuel-injection system for an internal combustion engine. The fuel-injection system contains a number of fuel injectors which are supplied with fuel by a high-pressure pump via a common inlet pipe and high-pressure lines leading from said pump to the individual fuel injectors. High-pressure storage devices are provided in each of the high-pressure lines in each of the high-pressure lines, the fuel storage volumes of said high-pressure storage devices being between 80 and 300 times, preferably between 120 and 200 times the maximum injection quantity per injection action. The diameter $D_2$ of the high-pressure lines leading from the common inlet pipe to the high-pressure storage devices is measured to minimize the difference in the quantities of fuel injected by the fuel injectors.

25 Claims, 2 Drawing Sheets

FUEL-INJECTION SYSTEM FOR AN INTERNAL COMBUSTION ENGINE

BACKGROUND AND SUMMARY OF THE INVENTION

The invention relates to a fuel injection system for an internal-combustion engine particularly a diesel engine, which contains a number of fuel injectors for injecting fuel into the combustion spaces of the internal-combustion engine and a high-pressure pump which supplies the fuel injectors with fuel by way of a common inflow pipe and high-pressure lines leading to the individual fuel injectors, as well as high-pressure storage devices which have a defined fuel storage volume and are provided in the high-pressure lines leading to the fuel injectors.

In the case of internal-combustion engines, particularly large-volume diesel engines, fuel injection systems are increasingly used in which fuel is supplied from a fuel supply by means of a high-pressure pump by way of a high-pressure line into a high-pressure storage device. From the high-pressure storage device acting as an oil-elastic storage device, the fuel is supplied by way of additional high-pressure lines to fuel injectors which inject the fuel during injection operations into the combustion spaces of the internal-combustion engine. So far, the high-pressure storage device has predominantly been provided in the form of a so-called common rail which is a tube-shaped elongated element from which the high-pressure lines branch off which supply the individual fuel injectors. Furthermore, fuel injection systems are known in the case of which, in addition to or instead of such a common high-pressure storage device in the form of a common rail, high-pressure storage devices are provided as individual storage devices separately for each fuel injector.

Fuel injection systems, in the case of which, in addition to a common high-pressure storage device, one individual storage device respectively is provided separately for each fuel injector are known from German Patent Documents 43 41 543 A1 and DE 43 41 546 A1. In the case of the fuel injection system known from the former document, a parallel switching device consisting of a return valve, which is interconnected in the fuel conveying direction, and of a throttle is provided in the high-pressure line leading from the common high-pressure storage device to the high-pressure storage device provided separately for each fuel injector, the system prevents an uncontrolled flowing-back of fuel from the separate high-pressure storage device into the common high-pressure storage device and prevents an influencing of the pressure in the separate pressure storage spaces of the other fuel injectors, while to the return valve permits a rapid refilling of the separate high-pressure storage devices from the common high-pressure storage device. Such measures for avoiding the mutual influencing of the pressure in the separate high-pressure storage devices are not provided in the case of the fuel injection system known from the second document.

Furthermore, a fuel injection system is known from German Patent Document DE 43 44 190 A1, in which fuel is fed under a high pressure to high-pressure storage devices separately provided for each fuel injector from a fuel supply by way of high-pressure lines by means of a high-pressure pump. A shut-off valve is connected into each high-pressure line connecting a fuel injector with the assigned high-pressure storage device, which shut-off valve has the purpose of limiting the fuel quantity flowing through during a pressure interval which is characterized by the pressure drop occurring with the injection operation or in the case of a leakage. However, measures are not indicated by means of which the mutual influencing of the pressure in the individual high-pressure storage devices is to be avoided.

It is an object of the invention to provide an improved fuel injection system for an internal-combustion engine.

According to the invention, a fuel injection system for an internal-combustion engine, particularly a diesel engine, is provided which contains a number of fuel injectors for injecting fuel into the combustion spaces of the internal-combustion engine as well as a high-pressure pump which supplies fuel to the fuel injectors by way of a common inlet pipe and to high-pressure lines leading to the individual fuel injectors. In the high-pressure lines leading to the fuel injectors, high-pressure storage devices are provided which each have a defined fuel storage volume. According to the invention, it is provided that the fuel storage volume of each high-pressure storage device amounts to between 80 and 300 times, preferably between 120 and 200 times the maximal injection quantity per injection operation, and that the diameter $D_2$ of the high-pressure lines leading from the common inlet pipe to the high-pressure storage devices is dimensioned such that the difference in the quantities injected by the fuel injectors assumes a minimum.

The invention is essentially based on the recognition that a variation of the diameter $D_2$ of the high-pressure lines leading from the common inlet pipe to the high-pressure storage devices results already within a relatively small range in a significant change of the difference in the quantities injected by the individual fuel injectors and has a pronounced minimum in the range of the optimal diameter. By using this minimum, the fuel injection system can be designed such that the difference in the injected quantities is minimal and uniform ignition pressures can be achieved from one cylinder to the next. The minimum of the difference in the injected quantities indicates that the mutual influence of the individual pressure storage spaces also has a minimum.

A significant advantage of the fuel injection system according to the invention is the fact that the high-pressure lines supplying the individual high-pressure storage devices can have a small diameter and are therefore easy to bend and mount. It is another advantage that, for minimizing the mutual influencing of the individual high-pressure storage devices, no additional elements, such as return valves, are required. For example, because of the inertia of masses of the moved parts, valves have a delayed response behavior so that the propagation of pressure disturbances and the mutual influencing of the injectors cannot be prevented thereby. Since, in the case of the injection system according to the invention, the high-pressure lines supplying the individual high-pressure storage devices exercise a throttling effect on the fuel flowing through, a self-protection of the internal-combustion engine continues to exist against an overspeed because, in the event of the occurrence of such an overspeed, the high-pressure storage devices are being no longer completely filled.

It is preferably provided that the diameter $D_2$ of the high-pressure lines leading from the common inlet pipe to the high-pressure storage devices meets the following requirement:

$$D_2 \approx ((4\times(V_E+V_L))/cg_2\times\pi\times T_{ASP}))^{1/2}$$

wherein $V_E$ is the maximal injection volume per injection operation, $V_L$ is a control and leakage quantity per injection operation possibly occurring at the fuel injector, $cg_2$ is a standard value for the fuel flow rate in the line, $T_{ASP}$ is the time duration for an operating cycle of the internal-combustion engine; wherein the values for $V_E$, $V_L$ and $T_{ASP}$ are defined by the layout of the internal-combustion engine, and $cg_2$ is to amount to between 5 and 50 m/s. In the case of long thin lines, the value for $cg_2$ is between 5 and 25 m/s, and preferably between 7 and 9 m/s. In the case of short lines or throttle-type transitions, the value for $cg_2$ is between 10 and 50 m/s, preferably between 35 and 45 m/s. As a result, the optimal value for the diameter $D_2$ can be mathematically determined already during the layout of the internal-combustion engine. However, it is advantageous to determine by means of a variation of the diameter $D_2$ about the thus obtained value the value for the diameter $D_2$ of the high-pressure lines in practical tests, in the case of which diameter the difference in the quantities injected by the fuel injectors is in fact minimal, as explained above.

According to a further development of the invention, it is provided to determine the diameter $D_4$ of the high-pressure lines leading from the high-pressure storage devices to the fuel injectors to be at least so large that the flow rate $cg_4$ of the fuel in these high-pressure lines during the injection operation is no higher than 30 m/s, preferably no higher than 25 m/s.

Preferably, it is provided that the diameter $D_4$ of the high-pressure lines leading from the high-pressure storage devices to the fuel injectors meets the following requirement:

$$D_4 \geqq ((4 \times V_E)/(cg_4 \times \pi \times SD))^{1/2}$$

wherein $V_E$ is the maximal injection volume per injection operation, $cg_4$ is the permissible maximal flow rate of the fuel in the high pressure line 4, and SD is the duration of the injection operation.

According to another advantageous further development of the invention, it is provided that the following applies to the diameters $D_1$ of the common inlet pipe and $D_2$ of the high-pressure lines leading from the common inlet pipe to the high-pressure storage devices:

$$D_1 \geqq n_R^{1/2} \times D_2$$

wherein $n_R$ is the number of fuel injectors 5 connected to the common inlet pipe 1.

It is advantageously provided that the lengths of the high-pressure lines leading from the common inflow pipe to the high-pressure storage devices are identical. As a result, it is to be ensured that the mutual influencing of the individual high-pressure storage devices is the same for all fuel injectors. Other objects, advantages and novel features of the present invention will become apparent from the following detailed description of the invention when considered in conjunction with the accompanying drawings.

BRIEF DESCRIPTION OF THE DRAWINGS

It is particularly advantageous to coordinate the diameter and the length of the common inflow pipe and of the high-pressure lines leading from the common inflow pipe to the high-pressure storage device with respect to one another such that the dynamic flow resistance of the feed pipes for all fuel injectors is the same. By taking into account the diameter and the length of the common inflow pipe when determining the flow resistance in the feed pipes, it is achieved that the same conditions exist for the supply of all fuel injectors.

DETAILED DESCRIPTION OF THE DRAWINGS

Figure 1:
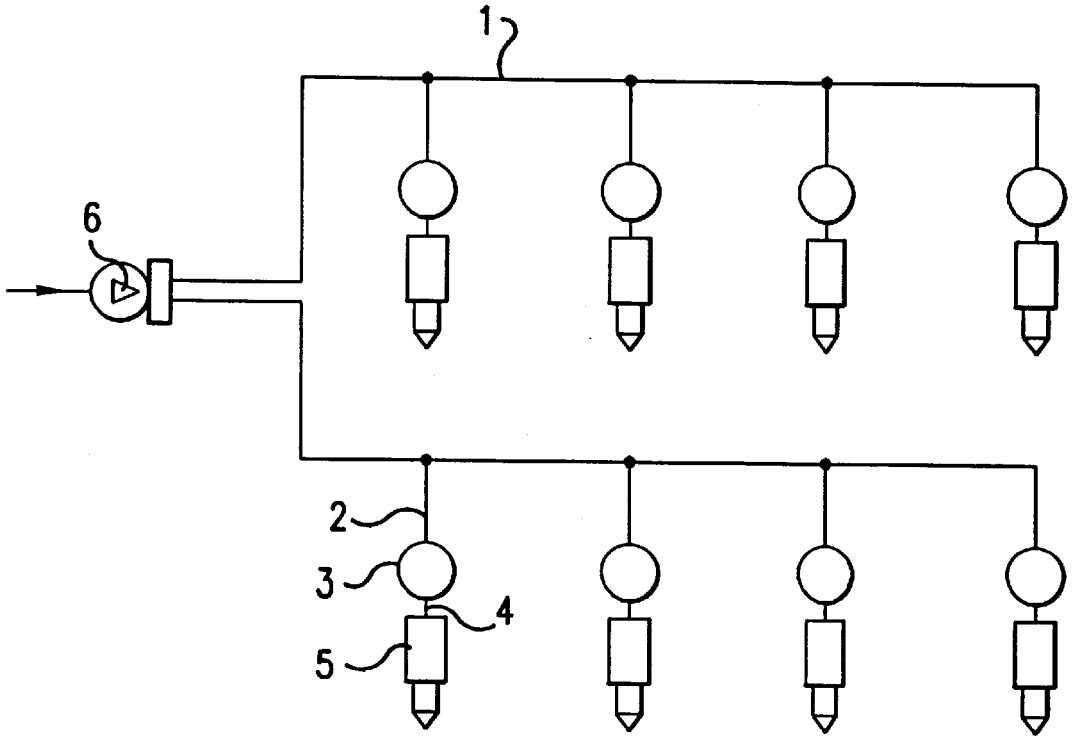

In the following, an embodiment of the invention will be explained by means of the drawing.

Figure 2:
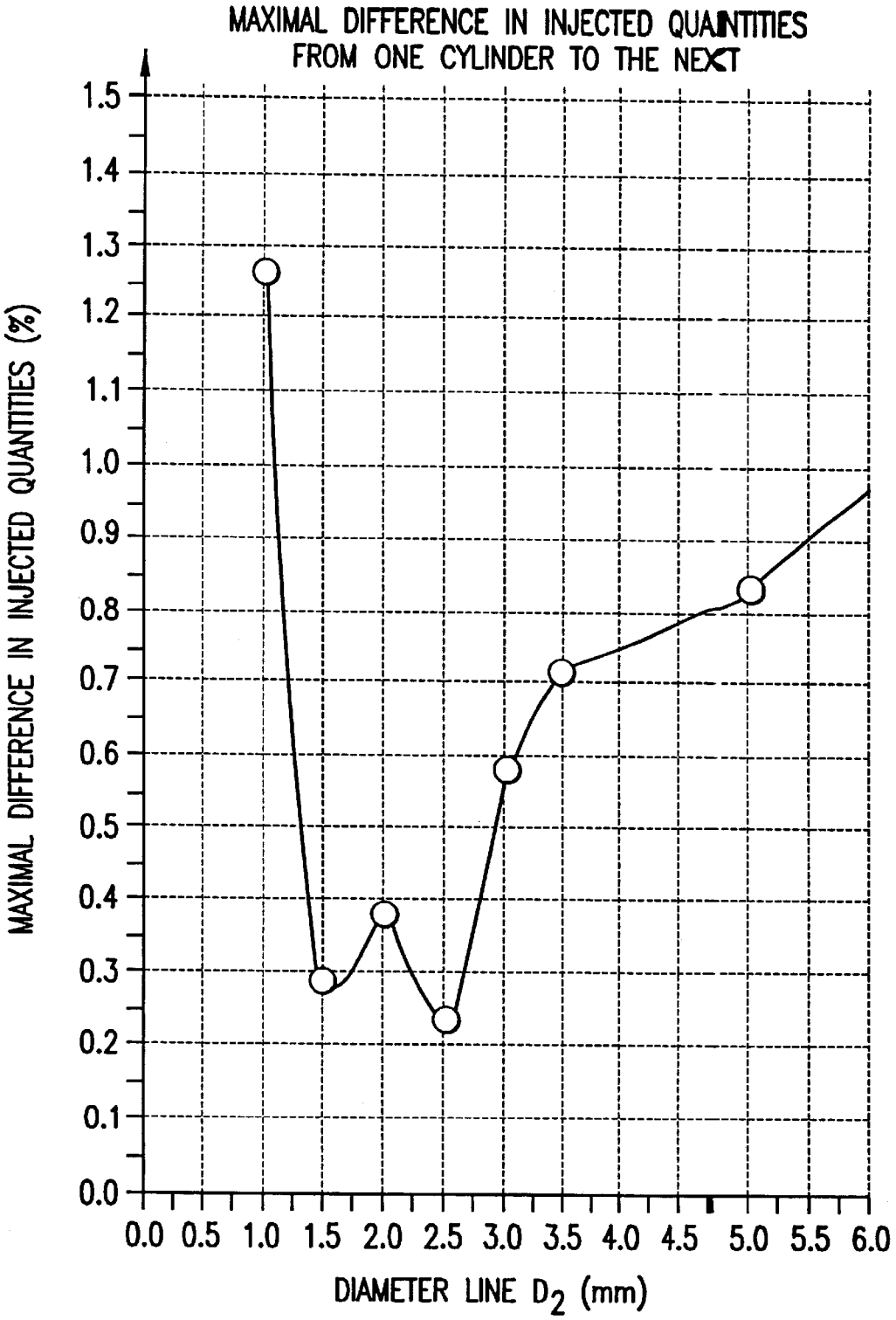

FIG. 1 is a schematic block diagram of a fuel injection system according to an embodiment of the invention; and FIG. 2 is a diagram which reflects the dependence of the difference in quantities injected by the individual fuel injectors with respect to one another on the diameter of the high-pressure lines supplying the high-pressure storage devices assigned to the individual fuel injectors.

The fuel injection system illustrated in FIG. 1 contains a number of fuel injectors 5 for injecting fuel into the combustion spaces of a internal-combustion engine, particularly a diesel engine. The fuel injectors 5 are controlled by means of a control unit, which is not illustrated separately in FIG. 1, in such a manner that a fuel quantity which is optimally adapted to the rotational speed and the load condition of the internal-combustion engine is injected into the combustion spaces of the internal-combustion engine. From a fuel supply, which is also not separately illustrated in FIG. 1, the fuel is first fed by means of one or several high-pressure pumps 6 to a common inflow pipe 1, from which high-pressure lines 2, 4 branch off which are used for supplying the individual fuel injectors 5. In the embodiment illustrated in FIG. 1, two inflow pipes 1 are provided which each supply four fuel injectors 5 jointly, as in the case of an 8V diesel engine.

In the high-pressure lines 2, 4 leading to the fuel injectors 5, high-pressure storage devices 3 are provided, specifically one respectively for each fuel injector 5. The portion of the high-pressure line leading from the common inflow pipe 1 to the high-pressure storage device 3 has the reference number 2; whereas the portion of the high-pressure line leading from the high pressure storage device 3 to the fuel injector 5 has the reference number 4.

The high-pressure storage devices 3 act as oil-elastic storage devices in whose fuel storage volume fuel, which is acted upon by the high pressure supplied by the high-pressure pump 6, is stored for the feeding to the fuel injectors 5. The fuel storage volume of each of the high-pressure storage devices 3 amounts to between 80 and 300 times, preferably between 120 and 200 times the maximal quantity of the fuel to be injected during each injection operation by a fuel injector 5 into the assigned combustion space of the internal-combustion engine.

The diameter $D_2$ of the portion 2 of the high-pressure line leading from the common inflow pipe 1 to the high-pressure storage device 3 is dimensioned such that the difference in the quantities injected by the fuel injectors assumes a minimum at the nominal rotational speed of the internal-combustion engine.

The diagram illustrated in FIG. 2 shows the maximal difference in the quantities injected by the individual fuel injectors; thus, the difference in the injected quantities from one cylinder of the internal-combustion engine to the next. During the implemented tests and calculations, the diameter $D_2$ of the high-pressure lines 2 leading from the common inflow pipe 1 to the high-pressure storage devices 3 was varied between 1.0 and 5.0 mm; in the range of 1.0 to 3.5 mm, in steps of 0.5 mm; and then in a further step of 1.5 mm.

As illustrated, the difference in injected quantities in the range of from 1.5 to 2.5 mm with values of between 0.25 to 0.35% has a minimum, whose concentration is at a diameter $D_2$ of 2.0 mm, but shows no local maximum there, which, however, will not be discussed here in detail. It is demonstrated that, at diameters of 1.5, 2.0 and 2.5 mm, minimal values of the difference in injected quantities are achieved in comparison to diameters of 1.0 and 3.0 mm. Tests with different rotational speeds and load conditions, as they occur most frequently during the operation of the internal-combustion engine, show which diameter $D_2$ is finally the most suitable one.

The optimal diameter $D_2$ of the high-pressure lines 2 leading from the common inflow pipe 1 to the high-pressure storage devices 3 can be mathematically represented by the following condition:

$$D_2 \approx ((4\times(V_E+V_L))/cg_2\times\pi\times T_{ASP}))^{1/2}$$

wherein $V_e$ is the maximal injection volume per injection operation, $V_L$ is a control and leakage quantity per injection operation possibly occurring at the fuel injector, $cg_2$ is a standard value for the fuel flow rate in the line, $T_{ASP}$ is the time duration for an operating cycle of the internal-combustion engine; wherein the values for $V_E$, $V_L$ and $T_{ASP}$ are defined by the layout of the internal-combustion engine, and $cg_2$ is to amount to between 5 and 50 m/s. In the case of long thin lines, the value for $cg_2$ is between 5 and 25 m/s, and preferably between 7 and 9 m/s. In the case of very short high-pressure lines 2, which in the extreme case represent throttle-type transitions or in the case of high-pressure lines 2 with throttle-type constrictions, a value for $cg_2$ in the area of the narrow points is assumed to be between 10 and 50 m/s, preferably between 35 and 45 m/s.

The significant influence of the diameter $D_2$ of the high-pressure lines 2 on the difference in the quantities injected by the individual fuel injectors can be explained by a strong damping of the returning pressure waves occurring during the opening and closing of the fuel injectors 5 in the high-pressure lines, by means of which pressure waves a mutual influencing of the individual high-pressure storage devices 3 and thus of the fuel quantities emitted by these high-pressure storage devices 3 to the fuel injectors 5 can be kept very low without additional measures, for example, by means of return valves or throttles.

The diameter $D_4$ of the high-pressure lines 4 leading from the high-pressure storage devices 3 to the fuel injectors 5 should be so large that the flow rate $cg_4$ of the fuel in these high-pressure lines during the injection operation should be no higher than 30 m/s, preferably no higher than 25 m/s, in order to avoid excessive pressure losses. Mathematically, this means that the diameter $D_4$ of the high-pressure lines 4 leading from the high-pressure storage devices 3 to the fuel injectors 5 meets the following requirement:

$$D_4 \geqq ((4\times V_E)/(cg_4\times\pi\times SD))^{1/2}$$

wherein $V_E$ is the maximal injection volume per injection operation, $cg_4$ is the permissible maximal flow rate of the fuel in the high pressure line 4, and SD is the duration of the injection operation.

In contrast to the fuel injection system with a common high-pressure storage device in the form of a common rail, in the case of the fuel injection system according to the invention, the common inflow pipe 1 is not used as a pressure storage device but only for filling the separate high-pressure storage devices 3 provided in the high-pressure lines 2, 4 leading from the common inflow pipe 1 to the fuel injectors 5. The following applies to the diameter $D_1$ of the common inlet pipe 1 and the diameter $D_2$ of the high-pressure lines 2 leading from the common inlet pipe 1 to the high-pressure storage devices 3:

$$D_1 \geqq n_R^{1/2}\times D_2$$

wherein $n_R$ is the number of fuel injectors 5 connected to the common inlet pipe 1.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

It is an important object of the invention to minimize as much as possible the mutual influencing of the pressure in the individual high-pressure storage devices 3 without the use of additional mass-incorporating and therefore sluggishly reacting components and to obtain a minimal difference in the injection quantities of the fuel injectors 5. For this purpose, it is required that essentially the same conditions apply to the individual fuel injectors 5 with respect to their supply with fuel subjected to a high pressure. In addition to an identical layout of the high-pressure storage device 3, this is achieved in that the lengths of the high-pressure lines leading from the common inflow pipe 1 to the high-pressure storage devices 3, as well as of the high-pressure lines 4 leading from the high-pressure storage devices 3 to the fuel injectors 5 are identical. If, in another step, the flow-dynamical conditions in the common inflow pipe 1 are also taken into account, the diameter and the length of the common inflow pipe 1 and of the high-pressure lines 2 leading from the common inflow pipe 1 to the high-pressure storage devices 3 are mutually coordinated such that the flow resistance of the high-pressure lines 2 and of the assigned portions of the common inflow pipe 1 is identical for all fuel injectors 5.

What is claimed is:

1. Fuel injection system for an internal-combustion engine, comprising:

a plurality of fuel injectors for injecting fuel into combustion spaces of the internal-combustion engine;

a high-pressure pump which supplies the fuel injectors with fuel via a common inflow pipe and high-pressure lines leading to the fuel injectors;

a plurality of high-pressure storage devices which have a defined fuel storage volume and are provided in the high-pressure lines leading to the fuel injectors, wherein the fuel storage volume of each of the high-pressure storage devices is between 80 and 300 times a maximal injected quantity per injection operation, and wherein the diameter $D_2$ of the high-pressure lines leading from the common inflow pipe to the high-pressure storage devices is dimensioned to have a predetermined value such that these high-pressure lines impart a throttling effect on the fuel flowing there through to the high-pressure storage devices and thereby minimize a difference in quantities of fuel injected by the fuel injectors.

2. Fuel injection system according to claim 1, wherein said fuel storage volume of each of the high-pressure storage devices is between 120 and 200 times the maximal injected quantity per injection operation.

3. Fuel injection system according to claim 1, wherein the diameter $D_2$ of the high-pressure lines leading from the common inflow pipe to the high-pressure storage devices meets the requirement:

$$D_2 \approx ((4\times(V_E+V_L))/cg_2\times\pi\times T_{ASP}))^{1/2}$$

wherein $V_E$ is the maximal injection volume per injection operation, $V_L$ is a control and leakage quantity per injection operation occurring at the fuel injector, $cg_2$ is a standard value for the fuel flow rate in the line, $T_{ASP}$ is the time duration for an operating cycle of the internal-combustion engine, wherein the values for $V_E$, $V_L$ and $T_{ASP}$ are defined by the layout of the internal-combustion engine, and $cg_2$ is between 5 and 50 m/s.

4. Fuel injection system according to claim 1, wherein $cg_2$ is a value for fuel flow rate in said high-pressure lines, and wherein said high-pressure lines are relatively long and thin such that the value of $cg_2$ is between 5 and 25 m/s.

5. Fuel injection system according to claim 4, wherein the value of $cg_2$ is between $_7$ and 9 m/s.

6. Fuel injection system according to claim 1, wherein $cq_2$ is a value for fuel flow rate in said high-pressure lines, and wherein throttle-type constrictions are present in at least one of said high-pressure lines and an area between the inflow pipe and the high-pressure lines, and the value of $cg_2$ at said throttle-type constrictions is between 10 and 50 m/s.

7. Fuel injection system according to claim 6, wherein the value of $cg_2$ at said throttle-type constrictions is between 35 and 45 m/s.

8. Fuel injection system according to claim 1, wherein the diameter $D_4$ of the high-pressure lines leading from the high-pressure storage devices to the fuel injectors is dimensioned such that the flow rate $cg_4$ of the fuel in said high-pressure lines during the injection operation is no higher than 30 m/s.

9. Fuel injection system according to claim 8, wherein the diameter $D_4$ of the high-pressure lines leading from the high-pressure storage devices to the fuel injectors is dimensioned such that the flow rate $cg_4$ of the fuel in said high-pressure lines during the injection operation is no higher than 25 m/s.

10. Fuel injection system according to claim 8, wherein the diameter $D_4$ of the high-pressure lines leading from the high-pressure storage devices to the fuel injectors meets the requirement:

$$D_4 \geqq (4\times V_E)/(cg_4\times\pi\times SD))^{1/2}$$

wherein $V_E$ is the maximal injection volume per injection operation, $cg_4$ is the maximal permissible flow rate of the fuel in the high-pressure line, and SD is the duration of the injection operation.

11. Fuel injection system according to claim 1, wherein the diameter $D_1$ of the common inflow pipe and the diameter $D_2$ of the high-pressure lines leading from the common inlet pipe to the high-pressure storage devices meet the requirement:

$$D_1 \geqq n_R^{1/2}\times D_2$$

wherein $n_R$ is the number of fuel injectors connected to the common inflow pipe.

12. Fuel injection system according to claim 1, wherein the lengths of the high-pressure lines leading from the common inflow pipe to the high-pressure storage devices are identical.

13. Fuel injection system according to claim 10, wherein the diameter and the length of the inflow pipe and of the high-pressure lines leading from the common inflow pipe to the high-pressure storage devices are mutually coordinated such that the dynamic flow resistance of the inflow pipes is identical for all of the fuel injectors.

14. A method of making a fuel injection system for an internal combustion engine which includes:

a plurality of fuel injectors for injecting fuel into combustion spaces of the internal-combustion engine;

a high-pressure pump which supplies the fuel injectors with fuel via a common inflow pipe and high-pressure lines leading to the fuel injectors; and a plurality of high-pressure storage devices which have a defined fuel storage volume and are provided in the high-pressure lines leading to the fuel injectors, said method comprising:

designing the high-pressure storage devices so as to have a fuel storage volume of between 80 and 300 times a maximal injected quantity per injection operation of the fuel injectors, and determining the diameter $D_2$ of the high-pressure lines leading from the common inflow pipe to the high-pressure storage devices such that they impart a throttling effect on fuel flowing there through and thereby minimize differences in quantities of fuel injected by the fuel injectors during engine operations.

15. A method of making a fuel injection system according to claim 23, wherein the diameter $D_2$ of the high-pressure lines leading from the common inflow pipe to the high-pressure storage devices meets the requirement:

$$D_2 \approx ((4\times(V_E+V_L))/cg_2\times\pi\times T_{ASP}))^{1/2}$$

wherein $V_E$ is the maximal injection volume per injection operation, $V_L$ is a control and leakage quantity per injection operation occurring at the fuel injector, $cg_2$ is a standard value for the fuel flow rate in the line, $T_{ASP}$ is the time duration for an operating cycle of the internal-combustion engine, wherein the values for $V_E$, $V_L$ and $T_{ASP}$ are defined by the layout of the internal-combustion engine, and $cg_2$ is between 5 and 50 m/s.

16. A method of making a fuel injection system according to claim 14, wherein $cg_2$ is a value for fuel flow rate in said high-pressure lines, and wherein said high-pressure lines are relatively long and thin such that the value of $cg_2$ is between 5 and 25 m/s.

17. A method of making a fuel injection system according to claim 16, wherein the value of $cg_2$ is between 7 and 9 m/s.

18. A method of making a fuel injection system according to claim 14, wherein $cg_2$ is a value for fuel flow rate in said high-pressure lines, and wherein throttle-type constrictions are present in at least one of said high-pressure lines and an area between the inflow pipe and the high-pressure lines, and the value of $cg_2$ at said throttle-type constrictions is between 10 and 50 m/s.

19. A method of making a fuel injection system according to claim 18, wherein the value of $cg_2$ at said throttle-type constrictions is between 35 and 45 m/s.

20. A method of making a fuel injection system according to claim 14, wherein the diameter $D_4$ of the high-pressure lines leading from the high-pressure storage devices to the fuel injectors is dimensioned such that the flow rate $cg_4$ of the fuel in said high-pressure lines during the injection operation is no higher than 30 m/s.

21. A method of making a fuel injection system according to claim 20, wherein the diameter $D_4$ of the high-pressure lines leading from the high-pressure storage devices to the fuel injectors is dimensioned such that the flow rate $cg_4$ of the fuel in said high-pressure lines during the injection operation is no higher than 25 m/s.

22. A method of making a fuel injection system according to claim 20, wherein the diameter $D_4$ of the high-pressure lines leading from the high-pressure storage devices to the fuel injectors meets the requirement:

$$D_4 \geqq ((4 \times V_E)/(cg_4 \times \pi \times SD))^{1/2}$$

wherein $V_E$ is the maximal injection volume per injection operation, $cg_4$ is the maximal permissible flow rate of the fuel in the high-pressure line, and SD is the duration of the injection operation.

23. A method of making a fuel injection system according to claim 14, wherein the diameter $D_1$ of the common inflow pipe and the diameter $D_2$ of the high-pressure lines leading from the common inlet pipe to the high-pressure storage devices meet the requirement:

$$D_1 \geqq n_R^{1/2} \times D_2$$

wherein $n_R$ is the number of fuel injectors connected to the common inflow pipe.

24. A method of making a fuel injection system according to claim 14, wherein the lengths of the high-pressure lines leading from the common inflow pipe to the high-pressure storage devices are identical.

25. A method of making a fuel injection system according to claim 14, wherein the diameter and the length of the inflow pipe and of the high-pressure lines leading from the common inflow pipe to the high-pressure storage devices are mutually coordinated such that the dynamic flow resistance of the inflow pipes is identical for all of the fuel injectors.

* * * * *